US008834282B2

(12) United States Patent
Sclare et al.

(10) Patent No.: US 8,834,282 B2
(45) Date of Patent: Sep. 16, 2014

(54) CHILDREN'S MOTION DEVICE

(75) Inventors: Jacob Sclare, Dacula, GA (US); Alex Soriano, Atlanta, GA (US); Joseph W. Staley, Atlanta, GA (US)

(73) Assignee: Kids II, Inc., Atlanta, GA (US)

( * ) Notice: Subject to any disclaimer, the term of this patent is extended or adjusted under 35 U.S.C. 154(b) by 126 days.

(21) Appl. No.: 13/560,116

(22) Filed: Jul. 27, 2012

(65) Prior Publication Data

US 2013/0026805 A1 Jan. 31, 2013

Related U.S. Application Data

(60) Provisional application No. 61/512,571, filed on Jul. 28, 2011.

(51) Int. Cl.

| | |
|---|---|
| ***A63G 9/16*** | (2006.01) |
| ***A47D 13/10*** | (2006.01) |
| *A47D 9/02* | (2006.01) |

(52) U.S. Cl.

CPC ..... *A47D 9/02* (2013.01); *A47D 13/105* (2013.01)

USPC ..... 472/119

(58) Field of Classification Search

CPC ..... A47D 9/00; A47D 9/02; A47D 13/10; A47D 13/105; A47D 13/107; A63G 9/00; A63G 9/12; A63G 9/16

USPC ..... 472/118–125; 297/273–283; 5/105–109

See application file for complete search history.

(56) References Cited

U.S. PATENT DOCUMENTS

| | | | | |
|---|---|---|---|---|
| 5,803,817 | A * | 9/1998 | Stern | 472/118 |
| 6,692,368 | B1 * | 2/2004 | Hyun | 472/119 |
| 7,563,170 | B2 | 7/2009 | Bellows et al. | |
| 7,607,734 | B2 | 10/2009 | Clapper et al. | |
| 7,717,798 | B2 | 5/2010 | Bellows et al. | |
| 7,727,078 | B2 | 6/2010 | Arnold, IV et al. | |
| 7,770,971 | B2 | 8/2010 | Bellows et al. | |
| 7,789,762 | B2 | 9/2010 | Greger et al. | |
| 7,824,273 | B2 | 11/2010 | Clapper et al. | |
| 7,837,570 | B2 * | 11/2010 | Kwon | 472/119 |
| 7,874,927 | B2 | 1/2011 | Godiska | |
| 7,883,426 | B2 | 2/2011 | Bellows et al. | |
| 7,884,710 | B2 | 2/2011 | Godiska et al. | |
| 7,918,742 | B2 | 4/2011 | Clapper et al. | |
| 7,938,731 | B2 | 5/2011 | Papageorge et al. | |

(Continued)

*Primary Examiner* — Kien Nguyen

(74) *Attorney, Agent, or Firm* — Gardner Groff Greenwald & Villanueva, PC

(57) ABSTRACT

A motion device that provides a soothing motion for a child seated within the device to replicate a parent or caregiver cradling and/or swaying the child. Embodiments include a base frame configured to rest on a support surface, a support frame coupled to and extending upward from the base frame, and a seat assembly which is pivotably coupled to the support frame. The seat assembly moves in an oscillating motion about the pivot axis, which is selectively propelled by a drive mechanism or motor. The drive mechanism or motor is coupled to and/or is integral to the assembly and its speed and motion is controlled electronically. The pivot axis about which the seat assembly rotates is preferably configured to be at least slightly offset from the vertical axis, such that the seat assembly will "self-center" when at rest.

19 Claims, 3 Drawing Sheets

(56) References Cited

U.S. PATENT DOCUMENTS

| | | | | |
|---|---|---|---|---|
| 8,029,377 | B2 | 10/2011 | Velderman et al. | |
| 8,146,989 | B2 | 4/2012 | Godiska et al. | |
| 8,187,111 | B2 | 5/2012 | Velderman et al. | |
| 8,308,578 | B2 * | 11/2012 | Gilbert et al. | 472/119 |
| 8,313,390 | B2 * | 11/2012 | Lu | 472/118 |
| 2008/0136236 | A1 | 6/2008 | Kincaid et al. | |
| 2008/0146359 | A1 | 6/2008 | Godiska | |
| 2008/0146361 | A1 | 6/2008 | Godiska | |
| 2010/0127539 | A1 | 5/2010 | Bellows et al. | |
| 2010/0159428 | A1 | 6/2010 | Grasing et al. | |
| 2012/0205954 | A1 | 8/2012 | Pollack et al. | |

* cited by examiner

CHILDREN'S MOTION DEVICE

CROSS-REFERENCE TO RELATED APPLICATION

This application claims the benefit of U.S. Provisional Patent Application Ser. No. 61/512,571 filed Jul. 28, 2011, the entirety of which is hereby incorporated by reference herein.

FIELD OF THE INVENTION

The present invention relates generally to the field of motion devices for children.

SUMMARY

Various example embodiments of the present invention are directed to a children's motion device that provides a seating surface configured for generally horizontal swaying or oscillating motion about an axis that is preferably at least slightly offset from vertical. Example embodiments include a base frame, a support frame coupled to and extending upward from the base frame, and a seat assembly pivotably coupled to the support frame for oscillating movement with respect to the support frame. The seat assembly may include a swing arm pivotably coupled to the support frame and configured to support a seat frame within which a child can be received. The seat frame may be pivotably coupled to the swing arm, such that the seat frame can be selectively positioned in at least two seat-facing orientations. For example, the seat may be configured to pivot between a forward-facing position and a right-facing position, where the motion imparted to an infant or child in the forward-facing position is a side-to-side motion and the motion imparted to an infant or child in the right-facing position is a front-to-back motion.

According to example embodiments of the present invention, the axis of rotation of the seat assembly is preferably positioned such that the child's torso and legs move in an oscillating motion while the child's head remains largely stationary. The location of the axis of rotation of the seat assembly is advantageous in that it allows the movement of the seat assembly to replicate a common, soothing motion performed by a mother holding her child. The seat assembly's axis of rotation being at least slightly offset from the vertical is advantageous in that gravity will cause the seat assembly to "self-center."

In one aspect, the invention relates to a child motion device including a base frame configured to engage a support surface, a support frame coupled to and extending upward from the base frame, and a seat assembly. The seat assembly preferably includes a swing arm pivotably coupled to the support frame for oscillating movement with respect to said support frame, the swing arm being rotatable about an axis of rotation. The seat assembly preferably also includes a seat frame coupled to the swing arm, wherein said seat assembly includes a pivot mechanism which allows the seat frame to pivot relative to the swing arm and engage at least two seat facing orientations. The device preferably also includes a drive system for powering the seat assembly oscillation.

In another aspect, the invention relates to a child motion device including a base, a seat frame, and a swing arm mounted for pivotal oscillation relative to the base about an axis of rotation. The swing arm preferably includes a first end supporting the seat frame, and a second end opposite the axis of rotation from the first end. The device preferably also includes a drive mechanism, at least a portion of which being mounted to the second end of the swing arm.

In still another aspect, the invention relates to a child motion device including a base, a swing arm coupled to the base by a pivot shaft for rotational motion of the swing arm relative to the base about an axis of rotation defined by the pivot shaft, and a seat frame mounted to a first end of the swing arm at a first offset distance from the axis of rotation. The seat frame defines a length, and the first offset distance is preferably at least about 20% the seat frame length.

Hereafter, a brief description of an exemplary embodiment of the children's motion device is disclosed. Various changes and modifications to such a children's motion device, beyond those explicitly mentioned herein, are contemplated as being within the scope of the present invention. Notably, it is contemplated that the description herein of the orientation, location, shape, material, and construction method of various features is in no way limiting and may be modified while remaining within the scope.

BRIEF DESCRIPTION OF THE DRAWING FIGURES

DETAILED DESCRIPTION OF EXEMPLARY EMBODIMENTS OF THE INVENTION

Figure 1:
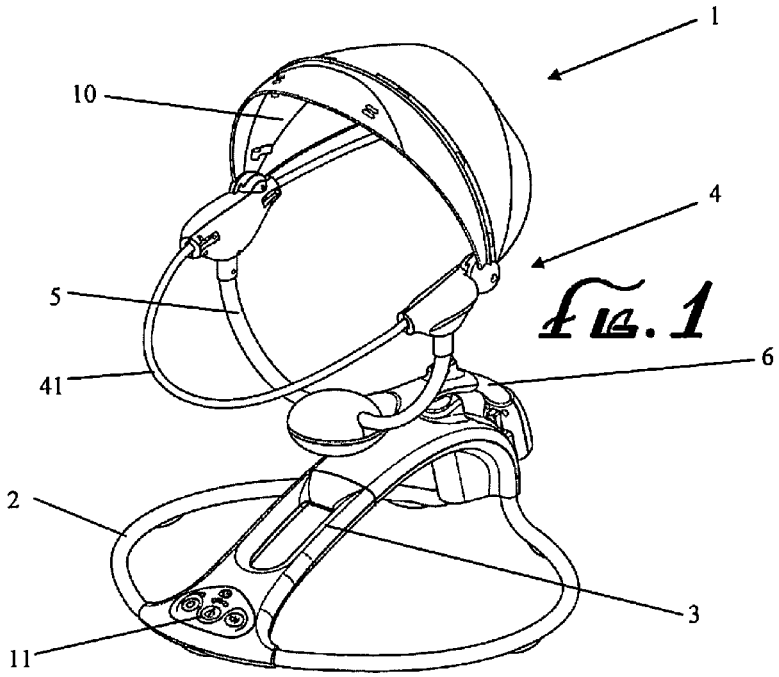
FIG. 1 shows a perspective view of a child motion device according to an example form of the present invention.
Figure 2:
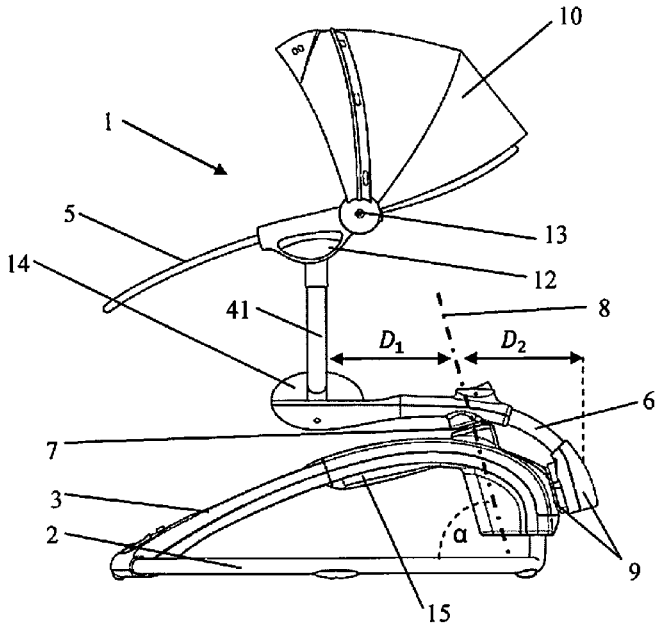
FIG. 2 shows a side view of the child motion device of FIG. 1.

FIG. 1 illustrates a child motion device (1), according to an example embodiment of the present invention. In this particular embodiment, the child motion device (1) comprises a base frame (2) configured to rest on a support surface (e.g. a floor, table top, etc.), a support frame (3) coupled to and extending upward from the base frame (2), and a seat assembly (4) pivotably attached to the support frame (3). The seat assembly (4) includes a seat frame (5) and a seat support yoke (41) that is coupled to a swing arm (6). The swing arm (6) is pivotably coupled to the support frame (3) via a pivot shaft (7) (as better seen in FIG. 2) extending upward from the support frame (3). The pivot shaft (7) defines an axis of rotation (8) that is preferably at least slightly offset from vertical (i.e. at an angle less than 90 degrees in relation to the support surface), as best shown in FIG. 2 below. In example embodiments, the axis of rotation (8) is offset from vertical by an angle $\alpha$ up to about 30°, for example about 15° (i.e., about 60°-90°, for example about 75° relative to the horizontal support surface). The angle of the axis of rotation (8) allows the seat assembly (4) to self-center when at rest. Due to the axis of rotation (8) being slightly offset from vertical, the oscillation of the seat assembly (4) does not occur in an entirely horizontal plane, but rather is similar to pendulum-type motion in which the position of the seat assembly is highest at the extremes of the motion arc and lowest at the center of the motion arc. Self-centering is the event in which gravity causes the seat assembly (4) to return to the lowest position of the motion arc (i.e. center) when it is not being driven. However, in alternative embodiments not configured to self-center, the axis of rotation (8) may be vertical. In alternate embodiments, various other means of self-centering the seat can be utilized, such as for example one or more springs, cords, magnetic elements or the like acting to bias the seat back to its center or equilibrium position.

Figure 5:
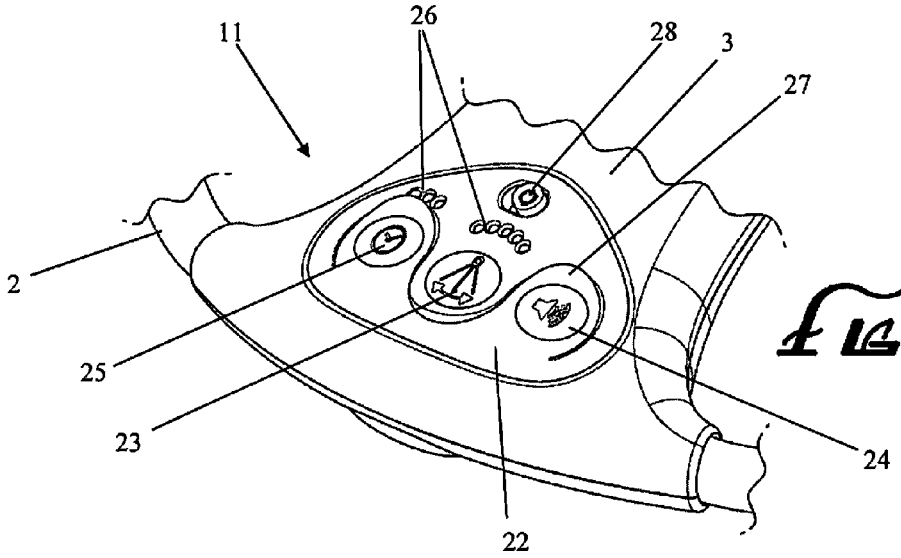
FIG. 5 shows a detailed perspective view of the user controls of the child motion device of FIG. 1, in example form.

The seat assembly (4) may include an infant-receiving pad or sling (not shown) supported by the seat frame (5) and into which an infant or child may be placed. Alternative embodiments of the seat assembly (4) may instead be configured with a bucket seat or other conventional seating device. The seat assembly (4) may further include a canopy device (10) to shade the infant or child or to support hanging toys. Moreover, the child motion device (1) includes user-selectable controls (11) for controlling variables such as the speed of the swing, volume of the music, and the period of time for which the seat assembly (4) will swing. The user-selectable controls (11) are positioned on the support frame (3) and configured such that a caregiver may operate the user-selectable controls (11) with either their feet or hands. The positioning of the user-selectable controls (11) allows the caregiver to keep both hands free and saves them the burden of bending forward or kneeling to operate the child motion device (1). The user-selectable controls (11) are best shown by FIG. 5 and are described in greater detail below. Furthermore, the child motion device (1) may include a restraint harness (not shown) configured to safely and securely retain an infant or child positioned within the seat assembly (4).

In example embodiments, the base frame (2) defines a generally circular footprint, optionally comprising first and second arcuate, semi-circular base members connected at diametrically opposed front and rear coupling members. For improved stability, the generally circular footprint of the base frame (2) optionally circumscribes or surrounds a vertical projection of all or a substantial portion of the remainder of the frame of the motion device (1), including the seat frame (5) and swing arm (6), with the exception of the outermost portion of the drive mechanism (9), in at least the centered or rest position of the device's range of motion. Stability is further enhanced by optionally maintaining at least the center of gravity of the seat frame and child within the vertical projection of the circular footprint of the base frame (2) throughout all or substantially all of its intended range of motion. The foot-operated controls (11) are optionally also within the circular footprint of the base frame (2), to prevent pressure applied on the controls from de-stabilizing the device. The angular offset of the rotational axis (8) is directed upwardly and inwardly, toward the center of the generally circular base frame (2) to position the seat frame generally over the center of the circular base frame.

Figure 3:
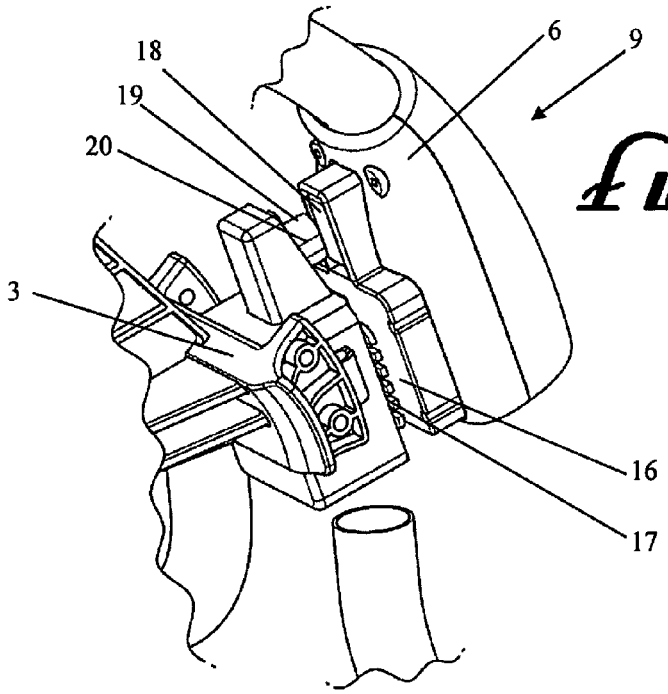
FIG. 3 shows a detailed perspective view of the drive mechanism of the child motion device of FIG. 1, in example form.
Figure 4:
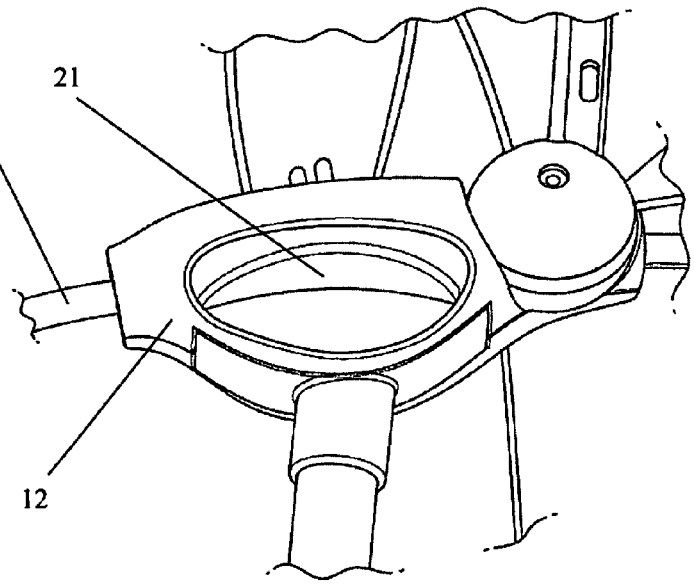
FIG. 4 shows a detailed perspective view of the seat frame recline mechanism of the child motion device of FIG. 1, in example form.
Figure 6:
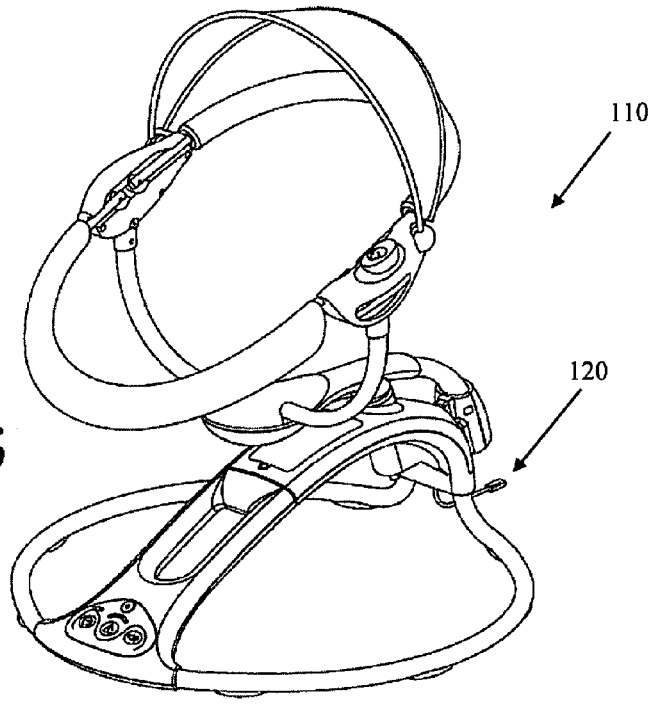
FIG. 6 shows another perspective view of a child motion device according to an example form of the present invention.

FIG. 2 is a side view of the child motion device (1) shown in FIG. 1. As seen in FIG. 2, the swing arm (6) is pivotably coupled to the support frame (3) via a pivot shaft (7) that extends upward from the support frame (3). The pivot shaft (7) defines an axis of rotation (8) that is slightly offset from the vertical axis (i.e. at an angle less than 90 degrees in relation to the support surface). The angle of the axis of rotation (8) allows the seat assembly (4) to self-center when at rest. The swing arm (6) is driven through oscillatory movement relative to the support frame (3) by a drive system (9), which is best shown in FIG. 3. Furthermore, as depicted in the drawing figures, the seat frame (5) includes a pair of seat support hubs (12) on either side of the seat frame (5). The seat support hubs (12) house a recline mechanism which allows the seat frame (5) to be pivoted between a plurality of recline positions. The recline mechanism is best shown in FIG. 4 and is further discussed below. Additionally, canopy hubs (13) are located at both sides of the canopy device (10) and house a pivot mechanism which allows a caregiver to expand or collapse the canopy device (10) as desired. Moreover, as shown, the seat assembly (4) is provided with a pivot mechanism (14) which allows the seat assembly (4) to pivot relative to the swing arm (6) between a plurality of seat-facing orientations. In a first forward-facing orientation, a generally side-to-side swaying motion will be imparted to the seat frame (5), and in a second side-facing position, a generally front-to-back swaying motion will be imparted to the seat frame (5). Other embodiments may furthermore include a rear-facing orientation, and/or any other orientation in between the front-, side-, and rear-facing orientations. Additionally, the child motion device (1) includes a battery compartment (15) positioned on the support frame (3). Inside the battery compartment (15) resides one or more batteries which power the drive system (9). Alternative embodiments may instead be configured to plug into an electrical outlet for power, and still other embodiments may include both options of plugging in to an outlet or using batteries, such that a user may selectively choose the power source. For example, FIG. 6 shows an alternate embodiment of a child motion device (110) having an electrical cord connection (120) for external power.

As seen with reference to FIG. 2, in example embodiments the seat pivot mechanism (14) is connected at a first or proximal end of the swing arm (6), the drive system (9) is attached at an opposite second or distal end of the swing arm, and the pivot shaft (7) is connected to an intermediate portion of the swing arm between the proximal and distal ends. Thus, as the drive mechanism moves in a first transverse direction, the seat moves in the opposite direction. A first horizontal offset distance $D_1$ is defined between the connection point of the pivot shaft (7) to the swing arm (6) and the point of connection of the seat pivot mechanism (14), and a second offset distance $D_2$ is defined between the connection point of the pivot shaft to the swing arm and the drive system (9). Selective variation of the first and second offset distances relative to one another adjusts the swing distance of the seat, and/or the mechanical advantage of the drive mechanism.

The first offset distance $D_1$ is optionally at least about 20%, and more preferably about 25-50% the lengthwise dimension of the seat frame (5), such that rotation of the swing arm (6) imparts a swinging or rocking motion to the seat, having both translational and rotational components, rather than a purely rotational or twisting motion. Increasing the first offset distance $D_1$ increases the circumferential arc length or translational swing distance of the seat for a given degree of angular rotation of the swing arm (6). In example embodiments, the first offset distance $D_1$ is selected to position the upper portion or head support area of the seat frame (5) where the child's head will rest in normal use in or proximal to alignment with the axis of rotation (8) of the pivot shaft (7) when the seat assembly (4) is positioned in its forward-facing orientation (as depicted in the figures) for side-to-side swaying motion; and is offset from alignment with the axis of rotation when the seat assembly is in its side-facing orientation for front-to-back swaying motion. Alternatively, the first offset distance can be selected to position the head support area of the seat frame (5) where the child's head will rest in normal use in or proximal to alignment with the axis of rotation (8) of the pivot shaft (7) when the seat assembly (4) is positioned in its its side-facing and/or forward-facing orientation(s).

FIG. 3 illustrates the drive system (9) of the child motion device (1), according to an example embodiment. In the depicted configuration of FIG. 3, the drive system (9) is an electromagnetic drive system which utilizes an electromagnetic (EM) coil (16) juxtaposed with a permanent magnet (17). (Alternatively, both magnetic components may be EM coils.) The EM coil (16) is preferably housed within the swing arm (6) and confronts the permanent magnet (17). The permanent magnet (17) is housed in the support frame (3) in proximity to the EM coil (16) and remains stationary with respect to the support frame, whereas the EM coil (16) moves rotationally relative to the support frame as the swing arm (6) pivotally oscillates. In alternative embodiments, the locations of the EM coil (16) and the permanent magnet (17) may be reversed. The EM coil (16) and permanent magnet (17) are substantially aligned when the seat is at rest and the EM coil (16) is not being energized. When the EM coil (16) is energized (e.g., at intervals pre-assigned by the electronic controls incorporated into the product), the EM coil (16) generates an electromagnetic field that repels against the permanent magnetic field(s) of the permanent magnet (17) and results in the oscillation of the seat assembly (4). This oscillatory movement may resemble a pendulum-type motion, being between the equal heights and angles to the right and left of the permanent magnet (17). The user-selectable controls (11) permit the amplitude of oscillation to be selectively adjusted by the caregiver to one of a plurality of angles with respect to the resting position of the seat assembly (4) on the axis about which it rotates. Other embodiments of the child motion device (1) may incorporate alternate drive means, such as a conventional gear-driven motor, and/or may be configured to be manually pushed by a caregiver.

In an example EM drive mechanism, the permanent magnet (17) of the EM drive system comprises a ferrous magnet stacked with a neodymium magnet. U.S. patent application Ser. No. 13/235,203, filed Sep. 16, 2011 is incorporated herein by reference. The electromagnetic coil (16) is configured to generate a magnetic force with the permanent magnet (17) when supplied with electric current from a power supply. As the direction of the electric current supplied to the electromagnetic coil (16) dictates its polarity, pulses of electric current transmitted to the coil may generate magnetic forces repelling the coil from the permanent magnet (17) (i.e., "push pulses") and/or a magnetic force attracting the coil to the permanent magnet (i.e., "pull pulses"). The magnetic forces generated by the magnetic components can thus be controlled to drive the seat assembly (4) such that it oscillates about the axis of rotation. By repeatedly transmitting electric current to the electromagnetic coil (16) as it passes by the permanent magnet (17), the seat assembly (4) can be continuously oscillated.

The amplitude of the oscillation is optionally controlled by a control circuit configured to control the timing, direction, and/or duration of electric current pulses supplied to the coil (16) based on input (e.g., a feedback signal) received from a sensor, such as a motion or proximity sensor, for example an infrared sensor and a reflective strip. In example embodiments the sensor generates a signal that can be received and processed by a control circuit. According to various other embodiments, the sensor may comprise an optical sensor, Hall effect sensor, laser sensor, accelerometer, light interrupter, or other sensor suitable for generating a signal indicative of the amplitude, frequency or velocity of the seat assembly (4) motion.

The control circuit can be configured to receive and process feedback information from the motion sensor and control the timing, direction, and duration of electric current pulses supplied to the coil (16) in order to drive the seat assembly (4) to oscillate at a user-preferred and controlled speed. The control circuit is configured to process the user's input selection and set the user-preferred amplitude as a goal amplitude. The control circuit then controls the characteristics of the electric current supplied to the EM coil (16) based on feedback from the motion sensor in order to drive the seat assembly (4) to continuously oscillate with an amplitude substantially equal to the goal amplitude.

Various alternative embodiments of the child motion device (1) can also include a motion sensor (not shown) that is used to track the speed of the seat assembly (4). In such example embodiments, the swing arm (6) includes a reflective tab (18) positioned in proximity to the EM coil (16) and the support frame (3) includes a laser (19) (or other light emitting device) configured to shine towards the reflective tab (18), such that the reflective tab (18) reflects the light from the laser (19) as the swing arm (6) passes in front of the laser (19) during oscillation. In alternate embodiments, other forms of proximity or motion sensors, such as for example infrared (IR) sensors or the like, may be utilized. A sensor (20) positioned on the support frame (3) in proximity to the laser (19) receives the reflected light as the swing arm (6) passes in front of the laser (19) and sends the information to an integrated circuit (IC), which tracks the frequency that the swing arm (6) passes the laser (19). The IC or other onboard or remote microprocessor can thus calculate the speed of the seat assembly (4) and signal control circuitry to adjust the speed according to the caregiver's selected preference. Various other embodiments of the child motion device (1) may not include a motion sensor or may include an alternative motion sensor, such as a sensor (20) configured to detect the blocking of ambient light when the swing arm (6) passes in front of the sensor (20). Additionally, alternative embodiments may include a motion sensor further configured to detect the direction in which the seat assembly (4) is travelling.

FIG. 4 illustrates an example seat support hub (12), according to an example embodiment. A seat support hub (12) (such that the child motion device includes at least two hubs) (12) may be located on either side of the seat frame (5) and may encompass pivot points around which the seat frame (5) can rotate. The degree of inclination can be adjusted by means of a pair of user accessible actuators (21) which are preferably formed within the seat support hubs (12). Preferably, both actuators (21) are actuated in tandem to recline the seat frame (5). According to alternative embodiments, the recline mechanism may be housed entirely in a single support hub (12). Various other embodiments may accomplish the recline feature by entirely different means, such as, for example, spring-loaded notches configured to selectively engage or disengage one of a plurality of locking grooves.

FIG. 5 illustrates exemplary user-selectable controls (11) for the child motion device (1), according to an example embodiment of the present invention. As shown, the user-selectable controls (11) are located on the support frame (3) and in proximity to the base frame (2). Thus, when the child motion device (1) is positioned on the ground, the user-selectable controls (11) are in proximity to the caregiver's feet. Operating the child motion device (1) with his/her foot leaves both of the caregiver's hands free to attend to the infant or child. The strain from bending forward or kneeling to operate the child motion device (1) is also avoided. However, the user-selectable controls (11) are not limited to use by the feet. If the caregiver prefers, he/she can manually operate the controls (11) by either reaching down to the controls (11) or by placing the child motion device (1) on a higher support surface. The user-selectable controls (11) of the depicted example embodiment comprise a flexible control panel (22) positioned above a plurality of internal control triggers (not shown). The controls (11) optionally include a speed control (23) to control the speed and/or magnitude of the swing arc, a volume control (24) to control the amplitude of included music and/or soothing noises, and a timer (25) which allows the caregiver to pre-set a period of time during which the seat assembly (4) will oscillate before returning to the rest position. Icons representing each of the speed control (23), volume control (24), and timer (25) are optionally formed into the plastic panel (22), and the corresponding trigger is internally positioned beneath the icon. Thus, as a caregiver's foot pushes down on the flexible plastic panel (22), the appropriate trigger will be actuated by the downward force. In example embodiments, both the speed control (23) and timer (25) can include a series of lights (26) that represent the selected speed and/or length of time, respectively, and that correspond to pre-determined intervals. For example, if each light (26) on the timer (25) represents an increment of 15 minutes, then if two lights (26) are on, the seat assembly (4) will oscillate for 30 minutes. Raised lips (27) formed in the flexible plastic panel (22) and adjacent to each of the speed, volume, and timer controls (23, 24, 25) are configured to facilitate the placement of a caregiver's foot on the desired control feature. The raised lips (27) further serve to aid in retaining the caregivers foot on the desired control feature, for situations in which the desired selection requires a caregiver to repeatedly engage a particular control, such as, for example, if the caregiver wishes to press the timer control (25) three times to set the timer (25) to 45 minutes. Additionally, the user-selectable controls (11) can include a power switch (28) which is configured to be slid by a caregiver between an "On" position in which power from the batteries (or other power system) is delivered to the drive system (9) and an "Off" position in which power to the drive system (9) is blocked. It should be noted that in alternative embodiments, the user-selectable controls (11) may be positioned elsewhere on the child-motion device (1) and configured to control different variables. For example, the controls (11) may be positioned higher up on the support frame (3), on the seat frame (5), on the base frame (2), etc. and furthermore may face forward, sideways, or rearward, such that a user stands in front of, to the side of, or behind the swing, respectively, to operate the controls. Alternatively operation of the device may be remotely controlled as for example by IR or radio communication from a remote transmitter to an onboard receiver. It should also be understood that the user-selectable controls (11) are not limited to the flexible plastic configuration described herein, and alternatively may be configured as depressible buttons or any other conventional input means.

While the invention has been described with reference to preferred and example embodiments, it will be understood by those skilled in the art that a variety of modifications, additions and deletions are within the scope of the invention, as defined by the following claims.

What is claimed is:

1. A child motion device comprising:

a base frame configured to engage a support surface;

a support frame coupled to and extending upward from the base frame;

a seat assembly comprising:

a swing arm pivotably coupled to said support frame for oscillating movement with respect to said support frame, said swing arm rotatable about an axis of rotation;

a seat frame coupled to said swing arm, wherein said seat assembly includes a pivot mechanism which allows said seat frame to pivot relative to said swing arm and engage at least two seat facing orientations; and a drive system for powering said seat assembly oscillation.

2. The child motion device of claim 1, wherein the pivot mechanism allows movement of the seat frame between a forward-facing orientation producing a generally side-to-side swaying motion and a side-facing position producing a generally front-to-back rocking motion.

3. The child motion device of claim 1, wherein the base frame defines a generally circular footprint.

4. The child motion device of claim 1, wherein the drive system for powering said seat assembly oscillation comprises an electromagnetic drive system.

5. The child motion device of claim 1, wherein the electromagnetic drive system comprises a first electromagnetic element mounted to the support frame and a second electromagnetic element mounted to the swing arm.

6. The child motion device of claim 5, wherein one of the first and second electromagnetic elements comprises a permanent magnet, and wherein the other of the first and second electromagnetic elements comprises an electromagnetic coil.

7. The child motion device of claim 1, wherein the seat frame is coupled to a first end of the swing arm, at least a portion of the drive system is coupled to an opposite second end of the swing arm, and wherein the support frame is coupled to the swing arm at an intermediate portion of the swing arm between the first and second ends.

8. The child motion device of claim 1, wherein the seat frame defines a length, and wherein a first offset distance defined between the axis of rotation of the swing arm and the pivot mechanism is at least about 20% the seat frame length.

9. A child motion device comprising:

a base;

a seat frame;

a swing arm mounted for pivotal oscillation relative to the base about an axis of rotation, the swing arm having a first end supporting the seat frame, and a second end opposite the axis of rotation from the first end; and a drive mechanism, at least a portion of which being mounted to the second end of the swing arm;

wherein the seat frame is pivotally mounted relative to the swing arm for movement between a forward-facing orientation producing a generally side-to-side swaying motion and a side-facing position producing a generally front-to-back rocking motion.

10. The child motion device of claim 9, wherein the base defines a generally circular footprint.

11. The child motion device of claim 9, wherein the drive mechanism comprises an electromagnetic drive.

12. The child motion device of claim 11, wherein the electromagnetic drive comprises a permanent magnet component and an electromagnetic coil.

13. A child motion device comprising:

a base;

a seat frame;

a swing arm mounted for pivotal oscillation relative to the base about an axis of rotation, the swing arm having a first end supporting the seat frame, and a second end opposite the axis of rotation from the first end; and a drive mechanism, at least a portion of which being mounted to the second end of the swing arm, wherein the drive mechanism comprises an electromagnetic drive; and wherein the seat frame defines a length, and wherein a first offset distance defined between the first end of the swing arm and the axis of rotation is at least about 20% the seat frame length.

14. A child motion device comprising:

a base;

a swing arm coupled to the base by a pivot shaft for rotational motion of the swing arm relative to the base about an axis of rotation defined by the pivot shaft;

a seat frame mounted to a first end of the swing arm at a first offset distance from the axis of rotation, the seat frame defining a length, and the first offset distance being at least about 20% the seat frame length.

15. The child motion device of claim 14, further comprising a drive mechanism element mounted to a second end of the swing arm opposite the axis of rotation from the first end.

16. The child motion device of claim 15, wherein the drive mechanism element is a component of an electromagnetic drive system selected from a permanent magnet and an electromagnetic coil.

17. The child motion device of claim 14, wherein the seat frame is pivotally mounted relative to the swing arm for movement between a forward-facing orientation producing a generally side-to-side swaying motion and a side-facing position producing a generally front-to-back rocking motion.

18. The child motion device of claim 14, wherein the base defines a generally circular footprint.

19. The child motion device of claim 14, wherein the pivot shaft extends at an oblique angle relative to the base.

* * * * *